US006014785A

United States Patent [19]

Punch et al.

[11] Patent Number: 6,014,785

[45] Date of Patent: Jan. 18, 2000

[54] MULTI-PURPOSE TOOL

[76] Inventors: David W. Punch; Shirley Ann Punch, both of 80067 N. Willie Rd., Folsom, La. 70437

[21] Appl. No.: 09/018,383

[22] Filed: Feb. 4, 1998

[51] Int. Cl.[7] ..... A46B 17/08

[52] U.S. Cl. ..... 7/105; 7/151; 7/165; 7/167; 15/111

[58] Field of Search ..... 7/105, 151, 165, 7/167, 170; 15/105, 111, 159.1

[56] References Cited

U.S. PATENT DOCUMENTS

| | | | |
|---|---|---|---|
| 181,206 | 8/1876 | Richardson | 7/105 X |
| 812,740 | 2/1906 | Harris et al. | 7/105 |
| 1,421,478 | 7/1922 | Hope | 7/105 X |
| 3,874,021 | 4/1975 | Jacobs | 15/202 |
| 4,134,171 | 1/1979 | Love | 15/146 |
| 5,218,733 | 6/1993 | Leu | 15/146 |
| 5,351,350 | 10/1994 | Johnson | 7/105 |
| 5,359,749 | 11/1994 | Chu | 15/176.1 |
| 5,575,030 | 11/1996 | Girard | 7/105 X |
| 5,894,624 | 4/1999 | Fulenwider | 7/105 X |

*Primary Examiner*—D. S. Meislin
*Attorney, Agent, or Firm*—Joseph N. Breaux

[57] ABSTRACT

There is provided a multi-purpose tool which comprises a paint brush having a bristle portion, a ferrule removable from the bristle portion, and a handle removable from the ferrule. When a cap at the free end of the handle is pivoted open, a pry blade is provided for removing a paint can lid. When the handle is removed from the ferrule, a reversible screwdriver inserted within a bore in the handle is provided for turning screws. When the ferrule is removed from the bristle portion, a scraper blade attached to the ferrule is provided for scraping a surface in preparation for painting. A belt mounted holster in also provided for permitting the user to carry the tool on his person.

14 Claims, 2 Drawing Sheets

MULTI-PURPOSE TOOL

TECHNICAL FIELD

The present invention relates to painting related tools, and, more particularly, is concerned with a single multi-purpose tool that can be used to scrape a surface to prepare it for painting, to open a can of paint, to apply the paint to the surface, and to remove or install screws and similar threaded fasteners.

BACKGROUND ART

The process of painting a structure, such as the interior or exterior of a house, typically involves several separate tasks, each requiring a separate tool. For example, in painting the exterior of a house, the painter typically must first use a hand held scraping tool to scrape portions of the surfaces to be painted to remove peeling or loose old paint and prepare the surface to receive new paint. After he has prepared the surface, the painter then uses a paint can opening tool, or other prying tool, to open the paint can to begin painting. When painting the interior of a room, the painter often must use a flat head or Phillips head screwdriver to remove light switch and electrical outlet cover plates and other items attached by screws to the walls or ceilings to be painted. Finally, the painter uses a paint brush to apply the paint to the surfaces. After the paint has dried, the painter again typically uses a screwdriver with the appropriate head to reattach items, such as light switch plates, that were removed from the walls prior to painting. Thus, the process of painting typically requires that the painter have at least four or five separate tools readily available for his use: a surface scraping tool, a paint can opening tool, a flat head and/or Phillips head screwdriver, and a paint brush.

Because a painter typically uses all or most of these tools repeatedly and frequently in the course of a painting job, in order to work efficiently, he must keep these separate tools close and within convenient reach while he is working. It is both inconvenient and cumbersome for a painter to keep up with and keep within his convenient reach a scraping tool, a paint can opener, flat head and Phillips head screwdrivers, and a paint brush while he is working.

Consequently, a need exists for a single combination or multi-purpose tool that can be used to scrape a surface to prepare it for painting, to open a can of paint, to apply paint to the surfaces, and to remove or install screws and similar threaded fasteners. A need also exists for a storage holster for the multi-purpose tool that can be attached to the user's clothing for carrying the tool on his person.

GENERAL SUMMARY DISCUSSION OF INVENTION

The present invention provides a multi-purpose painting tool and holster which answers the aforementioned needs. The invention also provides a method for preparing a surface for painting and painting the surface with paint from an initially closed paint can using the multi-purpose tool.

It is thus an object of the invention to provide a multi-purpose tool that can be used to scrape a surface to prepare it for painting, to open a can of paint, to apply the paint to the surface, and to remove or install screws and similar threaded Fasteners.

It is a further object of the invention to provide a method for preparing a surface for painting and for painting the surface with paint from an initially closed paint can using a single, multi-purpose tool.

It is a still further object of the invention to provide a multi-purpose tool having a scraper blade, a flat head screwdriver, a Phillips head screwdriver, a paint can opening pry blade, and paint applying bristles.

It is a still further object of the invention to provide a multi-purpose tool in which the scraper blade, the flat head and Phillips head screwdrivers, and the pry blade, when not in use, are concealed within the handle, the ferrule, or the bristle portion of the multi-purpose tool in such a manner that the tool resembles an ordinary paint brush when its component parts are connected together.

According to the invention, there is provided a multi-purpose tool which comprises a paint brush having a bristle portion, a ferrule removably connected to the bristle portion, and a handle removably connected to the ferrule. A pry blade extends axially from the free end of the handle for opening a can of paint. A reversible screwdriver extends from the opposite end of the handle. A scraper blade extends from the ferrule. The invention also provides a holster adapted for carrying the multi-purpose tool on the person using the tool.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
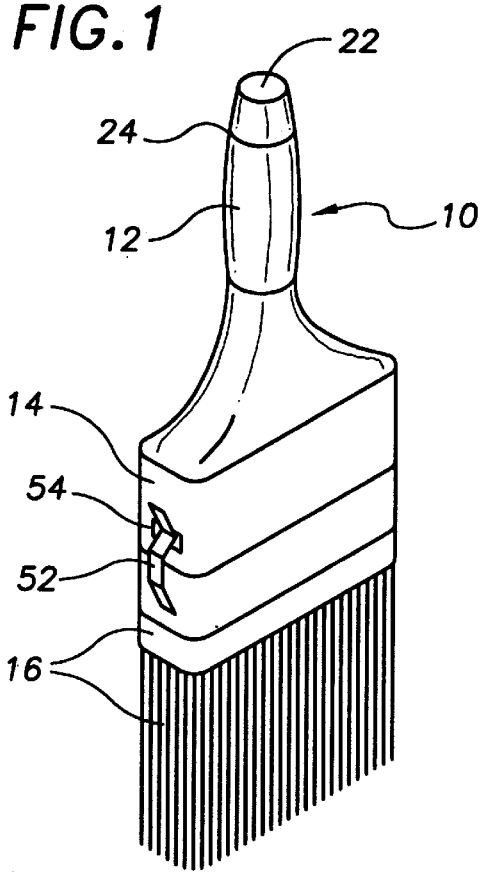
FIG. 1 is a perspective view of a preferred embodiment of the multi-purpose tool of this invention.

The preferred embodiment of the present invention and its advantages are best understood by referring to the drawings, like numerals being used for like and corresponding parts of the various drawings.

In FIG. 1 there is shown, in perspective view, a multi-purpose tool, generally designated 10, which embodies the present invention. multi-purpose tool 10 principally includes a handle 12, a ferrule 14, and a bristle portion 16.

Figure 2:
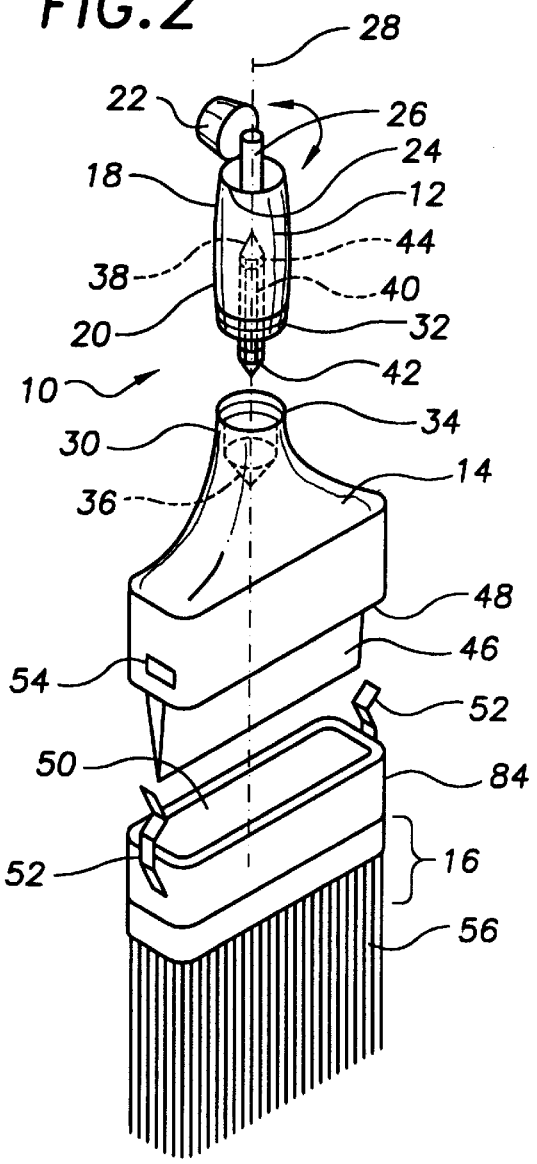
FIG. 2 is an exploded, perspective view of the multi-purpose tool of FIG. 1, with the cap shown in its open position.
Figure 3:
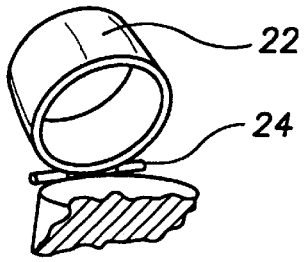
FIG. 3 is an enlarged, perspective view of the cap which is shown in FIGS. 1 and 2 attached to the handle of the multi-purpose tool.

Referring to FIG. 2, handle 12 has an upper, first end 18 and a lower, second end 20. A cap 22 is attached by hinge 24 to first end 18 of handle 12, as best seen in FIG. 3. Cap 22 can be pivoted open as shown in FIG. 2 to expose pry blade 26, which extends out from first end 18 of handle 12 along the centerline axis 28 of handle 12. Pry blade 26 preferably extends approximately ¾ inch from first end 18 of handle 12.

When cap 22 is pivoted open, multi-purpose tool 10 can be used as a paint can opener by inserting pry blade 26 under the raised edge of a paint can lid (not shown) and applying leverage force to handle 12 to lift the lid from the paint can. After opening the paint can, the user of multi-purpose tool 10 closes cap 22 down over pry blade 26. As seen in FIG. 1, when cap 22 is closed, cap 22 completely conceals pry blade 26 and forms an extension of handle 12 that gives multi-purpose tool 10 the appearance of a conventional paint brush and facilitates the use of multi-purpose tool 10 for other purposes.

Figure 4:
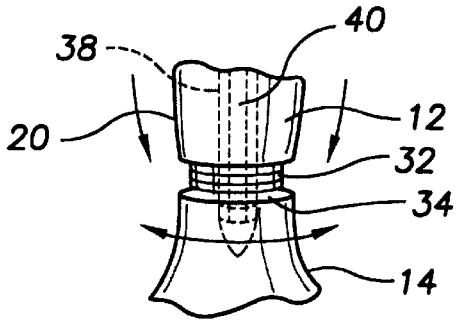
FIG. 4 is an enlarged, perspective view of the lower portion of the handle detached from the upper portion of the ferrule of the multi-purpose tool of FIGS. 1 and 2.

Second end 20 of handle 12 is threadably connectable and detachable from first side 30 of ferrule 14. Preferably, male threads 32 on handle 12 mate with female threads 34 within bore 36 of ferrule 14, as best seen in FIG. 4.

Second end 20 of handle 12 also has an axial bore 38 for removably receiving either end of screwdriver 40. Screwdriver 40 has a Phillips head 42 on one end and a flat head 44 on the opposite end. Screwdriver 40 is longer than the depth of bore 38 in handle 12 so that when either end 42 or 44 of screwdriver 40 is inserted into bore 38, the opposite end of screwdriver 40 extends out from handle 12 for use in turning a screw or similar headed fastener. Preferably, both screwdriver 40 and axial bore 38 in handle 12 are hexagon-shaped in cross section so that screwdriver 40 will not turn relative to handle 12 when inserted therein. Preferably, screwdriver 40 is also secured within bore 38 of handle 12 by a slight friction hold that permits screwdriver 40 to be removed from handle 12 easily by manual hand effort, but that prevents screwdriver 40 from inadvertently falling out of bore 38 by the force of gravity.

When the user of multi-purpose tool 10 needs to loosen or tighten a screw, he simply unthreads and detaches handle 12 from ferrule 14 to expose screwdriver 40. If necessary, the user then removes screwdriver 40 from handle 12 and reinserts screwdriver 40 into bore 38 of handle 12 so that the desired head 42 or 44 is available to turn the screw by handle 12. When he has finished using screwdriver 40, the user rethreads handle 12 to threaded bore 36 of ferrule 14 to permit multi-purpose tool 10 to be used for one of its other purposes, such as a paint brush. Bore 36 of ferrule 14 has a diameter larger than that of screwdriver 40, and is of sufficient depth to fully receive the portion of screwdriver 40 that extends from handle 12 when handle 12 and ferrule 14 are threaded together.

Figure 5:
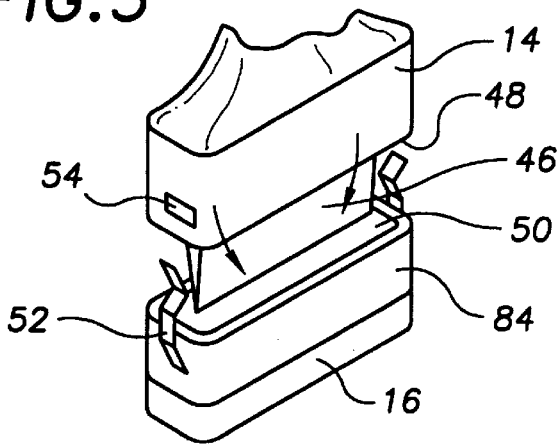
FIG. 5 is an enlarged, perspective view of the lower portion of the ferrule detached form the upper portion of the bristle portion of the multi-purpose tool of FIGS. 1 and 2.

A scraper blade 46 extends axially from second side 48 of ferrule 14. Ferrule 14 and bristle portion 16 are removably connectable together. As best seen in FIGS. 2 and 5, a rectangular shaped cavity 50 in bristle portion 16 fully receives scraper blade 50 when so connected.

A pair of clips 52, one on each end of bristle portion 16, mate with corresponding recesses 54 on opposite ends of ferrule 14 to secure ferrule 14 and bristle portion 16 together when scraper blade 46 is not in use. When the user of multi-purpose tool 10 needs to scrape a surface to prepare it for painting, the user simply bends clips 52 outward from recesses 54 to release ferrule 14 from bristle portion 16. Multi-purpose tool 10 can then be used as a scraper by manipulating scraper blade 46 by handle 12 to remove loose or peeling old paint from a surface to be painted.

After scraping the surface, the user of multi-purpose tool 10 reattaches ferrule 14 to bristle portion 16 by inserting scraper blade 46 into cavity 50 until clips 52 on bristle portion 16 mate with corresponding recesses 54 in ferrule 14. Multi-purpose tool 10 may then be used for one of its other purposes, such as a paint brush.

As seen in FIGS. 1 and 2, paint brush bristles 56 extend from the side of bristle portion 16 opposite cavity 50. When handle 12, ferrule 14, and bristle portion 16 are connected together, multi-purpose tool 10 can be used as a conventional paint brush. After use as a paint brush over a period of time, bristles 56, as the bristles of any paint brush, become worn and unsuitable for further use in painting. An inherent advantage of the present invention is that when bristles 56 become worn out, bristle portion 16 may be easily removed from multi-purpose tool 10, discarded, and replaced by a new bristle portion 16 (sold separately from multi-purpose tool 10). Bristle portion 16 can be manufactured and sold at a cost lower than that of an entire conventional paint brush. Thus, the owner of multi-purpose tool 10 realizes a cost savings in replacing only replaceable bristle portion 16 rather than the entire tool 10 when the paint brush bristles 56 become worn out.

Figure 6:
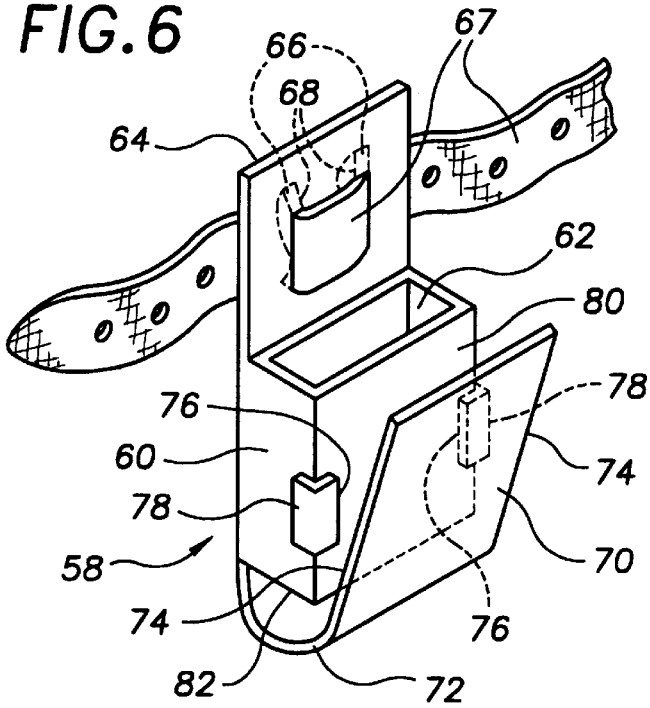
FIG. 6 is a perspective view of a preferred embodiment of the holster of this invention, shown as it might be attached to the belt of the tool user.

Referring now to FIG. 6, the present invention also includes a holster, generally designated 58, for carrying multi-purpose tool 10 on the person using the tool. Holster 58 includes a tool storage well 60 having an open upper end 62 into which the bristle end of multi-purpose tool 10 may be conveniently inserted when it is not in use. A tongue 64 extends from the upper rear wall of storage well 60 for attaching holster 58 to the user's clothing. In the preferred embodiment, a pair of belt clips 66 are attached to the rear surface of tongue 64 for securing holster 58 to the user's belt 67. Alternatively, tongue 64 may be provided with a pair of slots 68 through which the user's belt may be inserted.

A flap 70 is connected to the lower rear wall of storage well 60 by a plastic hinge 72. Before multi-purpose tool 10 is inserted into storage well 60, the opposite free edges 74 of flap 70 are inserted under edges 76 of plastic clips 78 to hold flap 70 upright and flush against the outer surface 80 of tool storage well 60. Like open end 62, lower end 82 of storage well 60 is open. Thus, when multi-purpose tool 10 is inserted into storage well 60 from open end 62, it is supported from the bottom by plastic hinge 72 of flap 70. Plastic hinge 72 is flexible and deformable so that flap 70 may be adjusted upward or downward with respect to storage well 60 to accommodate multi-purpose tools 10 of varying lengths.

When a painter or handyman wearing holster 58 needs to use multi-purpose tool 10 carried therein, he simply grasps multi-purpose tool 10 by its handle and lifts it from storage well 60. Alternatively, the user may grasp flap 70 and release its outer edges from plastic clips 78 by pivoting flap 70 outward from storage well 60. Further rotation of flap 70 from its upright position will permit multi-purpose tool 10 to be removed from holster 58 through the open lower end 82 of storage well 60.

Handle 12, ferrule 14, cap 22, and rigid part 84 of bristle portion 16 are preferably manufactured of "high impact" ABS plastic by the injection molding process in the conventional manner. Bristles 56 may be produced from a variety of conventional paint brush textiles, such as nylon or camel's hair.

Bristle portion 16 is preferably manufactured by assembling bristles 56 together in the shape desired for the end product, inserting the upper ends of the bristles into the injection mold cavity, and then molding the rigid part 84 of bristle portion 16 around the ends of bristles 56 to firmly secure bristles 56 to rigid part 84.

Pry blade 26, scraper blade 46, and clips 52 are preferably manufactured of nickel plated spring steel by the process of metal stamping or metal punching in the conventional manner. Hinge 24 is preferably manufactured of plastic or steel. Screwdriver 40 is preferably manufactured of hardened tool steel. Holster 58 may be manufactured of leather, imitation leather, or semirigid plastic. Belt clips 66 on holster 58 are preferably manufactured of spring steel. Multi-purpose tool 10 is preferably either 2 inches or 4 inches in width and approximately 10 inches in overall length.

It is noted that the embodiment of the multi-purpose tool described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A multi-purpose tool, which comprises:

a paint brush having a bristle portion, a ferrule removably connected to the bristle portion, and a handle removably connected to the ferrule;

means associated with the handle for opening a can of paint;

means associated with the handle for turning a fastener; and means associated with the ferrule for scraping a surface to be painted.

2. The multi-purpose tool of claim 1, wherein:

the handle is generally cylindrically shaped and has a free end opposite the ferrule; and the means for opening a can of paint comprises a pry blade extending axially from the free end of the handle.

3. The multi-purpose tool of claim 2, further including a cap hingedly connected to the free end of the handle for pivotal movement between an open position for exposing the pry blade when it is in use, and a closed position for covering the pry blade when it is not in use.

4. The multi-purpose tool of claim 1, wherein:

the handle is generally cylindrically shaped, being removably connected to the ferrule at one end; and the fastener turning means comprises a screwdriver extending axially from the end of the handle removably connected to the ferrule.

5. The multi-purpose tool of claim 4, wherein:

the screwdriver is longitudinally shaped with opposite ends and has a Phillips head on one end and a flat head on the opposite end; and the handle has an axial bore in the end removably connected to the ferrule for removably receiving either end of the screwdriver, whereby when one end of the screwdriver is inserted into the handle bore, the opposite end of the screwdriver extends therefrom for use in turning a fastener.

6. The multi-purpose tool of claim 4, wherein:

the handle and the ferrule are threadably connectable; and the ferrule has a bore therein for receiving the screwdriver portion extending from the handle when the handle and the ferrule are threadably connected together.

7. The multi-purpose tool of claim 1, wherein:

a side of the ferrule is removably connected to the bristle portion; and the surface scraping means comprises a scraper blade extending from the side of the ferrule removably connected to the bristle portion, the bristle portion having a corresponding cavity therein for receiving the scraper blade when the ferrule and the bristle portion are connected together.

8. The multi-purpose tool of claim 7, further including at least one clip attached to the paint brush for securing the ferrule to the bristle portion when the scraper blade is not in use.

9. A multi-purpose tool, which comprises:

a generally cylindrically shaped handle having a first end and a second end, the second end having an axial bore therein;

a pry blade extending axially from the first end of the handle for opening a can of paint;

a longitudinally shaped screwdriver having opposite ends and having a Phillips head on one end and a flat head on the other end, one end thereof being partially removably inserted into the axial bore in the handle, whereby the opposite end of the screwdriver extends axially from the second end of the handle for turning a screw;

a ferrule having a first side threadably connectable to the second end of the handle and having a bore therein for receiving the screwdriver portion extending from the handle end when the handle and the ferrule are threadably connected together, and having a second side opposite the first side of the ferrule;

a scraper blade extending from the second side of the ferrule for scraping a surface to be painted;

a bristle portion removably connectable to the second side of the ferrule for applying paint to a surface, the bristle portion having a cavity therein for receiving the scraper blade when the bristle portion and the ferrule are connected together; and at least one clip attached to one of the ferrule and the bristle portion for securing the ferrule and the bristle portion together when the scraper blade is not in use, the other of the ferrule and the bristle portion having corresponding recesses therein for receiving the at least one clip when the ferrule and the bristle portion are connected together.

10. The multi-purpose tool of claim 9, further including a cap hingedly connected to the first end of the handle for pivotal movement between an open position for exposing the pry blade when it is in use, and a closed position forming an extension of the handle for covering the pry blade when it is not in use.

11. The multi-purpose tool of claim 9, further including a holster adapted for carrying the multi-purpose tool on the person using the tool.

12. The multi-purpose tool of claim 11, wherein the holster comprises:

a tool storage well having upper and lower ends and an opening at said upper end for receiving the tool;

a tongue extending from said upper end of the tool storage well for attaching to the user's clothing; and a flap hingedly connected to the lower end of the tool storage well for securing the tool within the holster and for facilitating removal of the tool from the holster well.

13. A method for preparina a surface for painting and painting the surface with paint from an initially closed paint can using a multi-purpose tool, which comprises:

opening the paint can with a pry blade attached to the multi-purpose tool;

scraping the surface to be painted with a scraper blade attached to the multi-purpose tool;

painting the surface with bristles attached to the multi-purpose tool;

pivoting open a cap covering the pry blade on the multi-purpose tool;

inserting the pry blade under the edge of the paint can lid and applying leverage to a handle of the multi-purpose tool to remove the lid; and pivoting closed the cap on the multi-purpose tool to cover the pry blade.

14. The method of claim 13, wherein the step of scraping the surface comprises:

detaching a handle of the multi-purpose tool to which the scraper blade is attached from a bristle portion of the multi-purpose tool;

manipulating the scraper blade by the handle to scrape the surface to prepare it to receive paint; and reattaching the handle and attached scraper blade to the bristle portion of the multi-purpose tool.

* * * * *